US006354923B1

(12) United States Patent
Lankford

(10) Patent No.: US 6,354,923 B1
(45) Date of Patent: Mar. 12, 2002

(54) APPARATUS FOR PLANARIZING MICROELECTRONIC SUBSTRATES AND CONDITIONING PLANARIZING MEDIA

(75) Inventor: David Lankford, Eugene, OR (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/605,141

(22) Filed: Jun. 27, 2000

Related U.S. Application Data

(63) Continuation of application No. 08/996,047, filed on Dec. 22, 1997, now Pat. No. 6,083,085.

(51) Int. Cl.[7] ..... B24C 5/00; B24B 55/00

(52) U.S. Cl. ..... 451/72; 451/91; 451/443; 451/910

(58) Field of Search ..... 451/37, 56, 72, 451/91, 99, 102, 285, 286, 287, 288, 289, 290, 443, 446, 910

(56) References Cited

U.S. PATENT DOCUMENTS

| | | | | |
|---|---|---|---|---|
| 1,738,565 A | 12/1929 | Claypoole | 451/910 X |
| 2,163,650 A | 6/1939 | Weaver | 451/910 X |
| 2,468,550 A | 4/1949 | Fruth | 451/910 X |
| 2,647,846 A | 8/1953 | Bagno | 451/910 X |
| 2,702,692 A | 2/1955 | Kessler | 451/910 X |
| 5,245,790 A | 9/1993 | Jerbic | |
| 5,245,796 A | 9/1993 | Miller et al. | |
| 5,478,270 A | 12/1995 | Cuomo et al. | 451/56 X |
| 5,522,965 A | 6/1996 | Chisholm et al. | 156/636.1 |
| 5,868,608 A | 2/1999 | Allman et al. | 451/443 X |
| 5,916,010 A | 6/1999 | Varian et al. | 451/38 |
| 6,024,829 A | 2/2000 | Easter et al. | 156/345 |
| 6,083,085 A | 7/2000 | Lankford | 451/56 |

*Primary Examiner*—Timothy V. Eley
(74) *Attorney, Agent, or Firm*—Dorsey & Whitney LLP

(57) ABSTRACT

A method and apparatus for mechanical and/or chemical-mechanical planarization of microelectronic substrates. In one embodiment, a conditioning device for removing waste matter from a microelectronic planarizing medium has a support assembly with a support member and a conditioning head attached to the support member. The support member may be a pivoting arm or gantry assembly that carries the condition head over the planarizing medium. The conditioning head may have a non-contact conditioning element that transmits a form of non-contact energy to waste matter on the planarizing medium. The non-contact conditioning element, for example, may be an emitter that transmits a selected waveform capable of penetrating the planarizing medium and the waste matter on the planarizing medium. In operation, the selected non-contact energy may impart energy to the waste matter that weakens or breaks bonds in the waste matter and/or bonds between the planarizing medium and the waste matter.

9 Claims, 7 Drawing Sheets

APPARATUS FOR PLANARIZING MICROELECTRONIC SUBSTRATES AND CONDITIONING PLANARIZING MEDIA

CROSS-REFERENCE TO RELATED APPLICATIONS

This application is a continuation of U.S. patent application Ser. No. 08/996,047, filed Dec. 22, 1997, now U.S. Pat. No. 6,083,085 and is related to pending U.S. patent application Ser. No. 09/386,500, filed Aug. 30, 1999, which is a divisional of pending U.S. patent application Ser. No. 08/996,047, filed Dec. 22, 1997.

TECHNICAL FIELD

The present invention relates to mechanical and chemical-mechanical planarization of microelectronic substrates. More particularly, the present invention relates to conditioning polishing pads and other planarizing media used to planarize the surfaces of microelectronic substrates.

BACKGROUND OF THE INVENTION

Mechanical and chemical-mechanical planarization processes remove material from the surfaces of semiconductor wafers, field emission displays and many other microelectronic substrates to form a flat surface at a desired elevation. FIG. 1 schematically illustrates a planarizing machine 10 with a platen or base 20, a carrier assembly 30, a planarizing medium 40, and a planarizing solution 44 on the planarizing medium 40. The planarizing machine 10 may also have an under-pad 25 attached to an upper surface 22 of the platen 20 for supporting the planarizing medium 40. In many planarizing machines, a drive assembly 26 rotates (arrow A) and/or reciprocates (arrow B) the platen 20 to move the planarizing medium 40 during planarization.

The carrier assembly 30 controls and protects a substrate 12 during planarization. The carrier assembly 30 generally has a substrate holder 32 with a pad 34 that holds the substrate 12 via suction, and an actuator assembly 36 typically rotates and/or translates the substrate holder 32 (arrows C and D, respectively). However, the substrate holder 32 may be a weighted, free-floating disk (not shown) that slides over the planarizing medium 40.

The planarizing medium 40 and the planarizing solution 44 may separately, or in combination, define a polishing environment that mechanically and/or chemically-mechanically removes material from the surface of the substrate 12. The planarizing medium 40 may be a conventional polishing pad made from a relatively compressible, porous continuous phase matrix material (e.g., polyurethane), or it may be an abrasive polishing pad with abrasive particles fixedly bonded to a suspension medium. In a typical application, the planarizing solution 44 may be a chemical-mechanical planarization slurry with abrasive particles and chemicals for use with a conventional non-abrasive polishing pad, or the planarizing solution 44 may be a liquid without abrasive particles for use with an abrasive polishing pad.

To planarize the substrate 12 with the planarizing machine 10, the carrier assembly 30 presses the substrate 12 against a planarizing surface 42 of the planarizing medium 40 in the presence of the planarizing solution 44. The platen 20 and/or the substrate holder 32 then move relative to one another to translate the substrate 12 across the planarizing surface 42. As a result, the abrasive particles and/or the chemicals in the polishing environment remove material from the surface of the substrate 12.

Planarizing processes must consistently and accurately produce a uniformly planar surface on the substrate to enable precise fabrication of circuits and photo-patterns on the substrate. As the density of integrated circuits increases, the uniformity and planarity of the substrate surface is becoming increasingly important because it is difficult to form sub-micron features or photo-patterns to within a tolerance of approximately 0.1 $\mu$m when the substrate surface is not uniformly planar. Thus, planarizing processes must create a highly uniform, planar surface on the substrate.

In the competitive semiconductor and microelectronic device manufacturing industries, it is also desirable to maximize the yield of individual devices or dies on a substrate. Typical semiconductor manufacturing processes fabricate a plurality of dies (e.g., 50–250) on each substrate. To increase the number of dies that are fabricated on each substrate, many manufacturers are increasing the size of the substrates to provide more surface area for fabricating additional dies. Thus, to maximize the yield of operable dies on each substrate, planarizing processes should produce a uniformly planar surface across the entire substrate.

In conventional planarizing processes, the substrate surface may not be uniformly planar because the rate at which material is removed from the substrate surface (the "polishing rate") typically varies from one region on the substrate to another. The polishing rate is a function of several factors, and many of the factors may change during planarization. For example, some of the factors that effect the polishing rate across the substrate surface are as follows: (1) the distribution of abrasive particles and chemicals between the substrate surface and the planarizing medium; and (2) the condition of the planarizing surface on the planarizing medium.

To reduce deviations in the uniformity of the substrate surface, several existing planarizing media are polishing pads with holes or grooves that transport a portion of the planarizing solution below the substrate surface during planarization. A Rodel IC-1000 polishing pad, for example, is a relatively soft, porous polyurethane pad with a number of large slurry wells approximately 0.05–0.10 inches in diameter that are spaced apart from one another across the planarizing surface by approximately 0.125–0.25 inches. During planarization, small volumes of slurry are expected to fill the large wells, and then hydrodynamic forces created by the motion of the substrate are expected to draw the slurry out of the wells in a manner that wets the substrate surface. U.S. Pat. No. 5,216,843 describes another polishing pad with a plurality of macro-grooves formed in concentric circles and a plurality of micro-grooves radially crossing the macro-grooves. In such grooved pads, it is expected that the grooves hold a portion of the planarizing solution below the substrate surface during planarization.

Although polishing pads with holes or grooves improve the uniformity of substrate surfaces, they may not produce adequately uniform surfaces on substrates after several planarizing and conditioning cycles. One factor affecting the uniformity of the substrate surface is the condition of the polishing pad. The planarizing surface of the polishing pad typically deteriorates after polishing a number of substrates because waste matter from the substrate, planarizing solution and/or the polishing pad accumulates on the planarizing surface. For example, when a doped silicon glass layer is planarized, a portion of the glass glazes over areas of the planarizing surface. The waste matter typically does not accumulate uniformly across the planarizing surface, and thus the waste matter alters local polishing rates across the pad. Polishing pads are accordingly "conditioned" by removing the waste matter from the pad to restore the polishing pad to a suitable condition for planarizing substrates.

Polishing pads are conventionally conditioned with devices that contact the waste matter with an abrasive element or a water jet to remove the waste matter from the pad. One conventional method for conditioning polishing pads is to abrade the planarizing surface with a diamond end-effector that abrades the waste matter accumulations and exposes portions of the planarizing surface on top of the polishing pad. Another conventional method is to spray the polishing pad with a jet of deionized water that separates the waste matter accumulations from the polishing pad.

Conditioning polishing pads with the existing methods, however, may produce deviations in the uniformity of the substrate surface because it is difficult to consistently condition a polishing pad so that it has the same planarizing characteristics from one conditioning cycle to the next. For example, diamond end-effectors and water jets are surface contact elements that may not remove waste matter embedded in depressions below the planarizing surface (erg., holes, pores or grooves). Conventional conditioning systems accordingly. may not return such polishing pads to a state in which they can hold an adequate amount of planarizing solution below the substrate surface. Another concern of conventional conditioning systems is that diamond end-effectors may produce a non-planar surface on a polishing pad because they remove material from exposed areas on the planarizing surface while removing waste matter from covered areas on the planarizing surface. As such, diamond end-effectors may produce low points in the planarizing surface that were exposed at an early stage of a conditioning cycle. Conventional conditioning systems, therefore, may not return polishing pads and other planarizing media to a condition in which they uniformly planarize substrate surfaces.

SUMMARY OF THE INVENTION

The present invention is a method and apparatus for conditioning planarizing media used in mechanical and/or chemical-mechanical planarization of microelectronic substrates. In one embodiment, a conditioning device has a support assembly with a support member and a conditioning head attached to the support member. The support member may be a pivoting arm or gantry that carries the conditioning head over the planarizing medium. The conditioning head may have a non-contact conditioning element that transmits a form of non-contact energy to waste matter on the planarizing medium. The non-contact conditioning element, for example, may be an emitter that transmits a selected non-contact energy capable of penetrating the planarizing medium and the waste matter. In operation, the selected form of non-contact energy may weaken or break bonds in the waste matter and/or bonds between the planarizing medium and the waste matter.

In one particular embodiment, the conditioning head may have a carrier plate attached to the support member, a retention skirt depending downwardly from a perimeter portion of the carrier plate, and a fluid supply line attached to the carrier plate. The carrier plate and the retention skirt define a cavity, and the fluid supply line may have an outlet in the cavity. In this embodiment, the non-contact conditioning element may be a mechanical-wave transmitter attached to the carrier plate and coupled to a signal generator. The mechanical-wave transmitter, for example, may be an ultrasonic transducer that generates ultra-sonic energy-waves at desired frequencies and amplitudes. In operation, a fluid supply pumps deionized water through the fluid supply line to fill the cavity with a transmission medium, and the mechanical-wave transmitter sends mechanical energy-waves through the transmission medium to the planarizing medium. Several embodiments of the present invention may be particularly useful for removing waste matter accumulations from polishing media with depressions (e.g., holes, pores or grooves) because the mechanical energy-waves may separate the waste matter in the depressions from the planarizing media.

Another embodiment of the present invention also has a contact conditioning element attached to the carrier plate in addition to the non-contact conditioning element. The contact conditioning element may be a diamond disk or a sprayer that engages the waste matter in conjunction with the energy-waves from the non-contact conditioning element. For example, a diamond end-effector may be mounted to the carrier plate in the cavity along with a plurality of mechanical-wave transmitters to abrade the planarizing medium as the mechanical-wave transmitters transmit energy-waves against the planarizing medium.

DETAILED DESCRIPTION OF THE INVENTION

The present invention is an apparatus and method for mechanical and/or chemical-mechanical planarization of substrates used in the manufacturing of microelectronic devices. Many specific details of certain embodiments of the invention are set forth in the following description and in FIGS. 2–7 to provide a thorough understanding of such embodiments. One skilled in the art however, will understand that the present invention may have additional embodiments or that the invention may be practiced without several of the details described in the following description.

Figure 1:
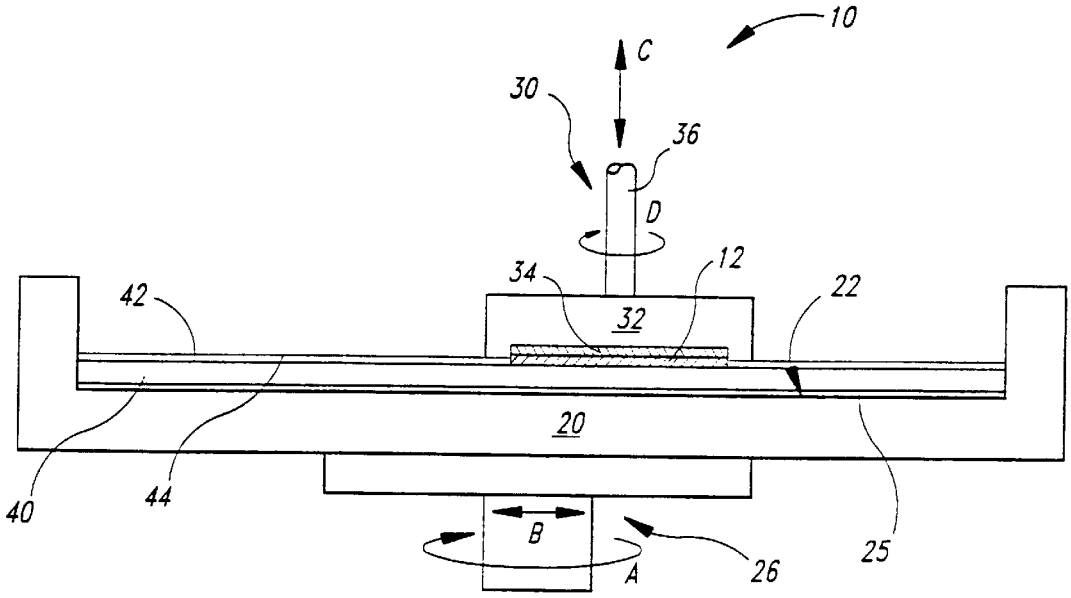
Fig. 1 (Prior Art)
FIG. 1 is a schematic view of a planarization machine in accordance with the prior art.
Figure 2:
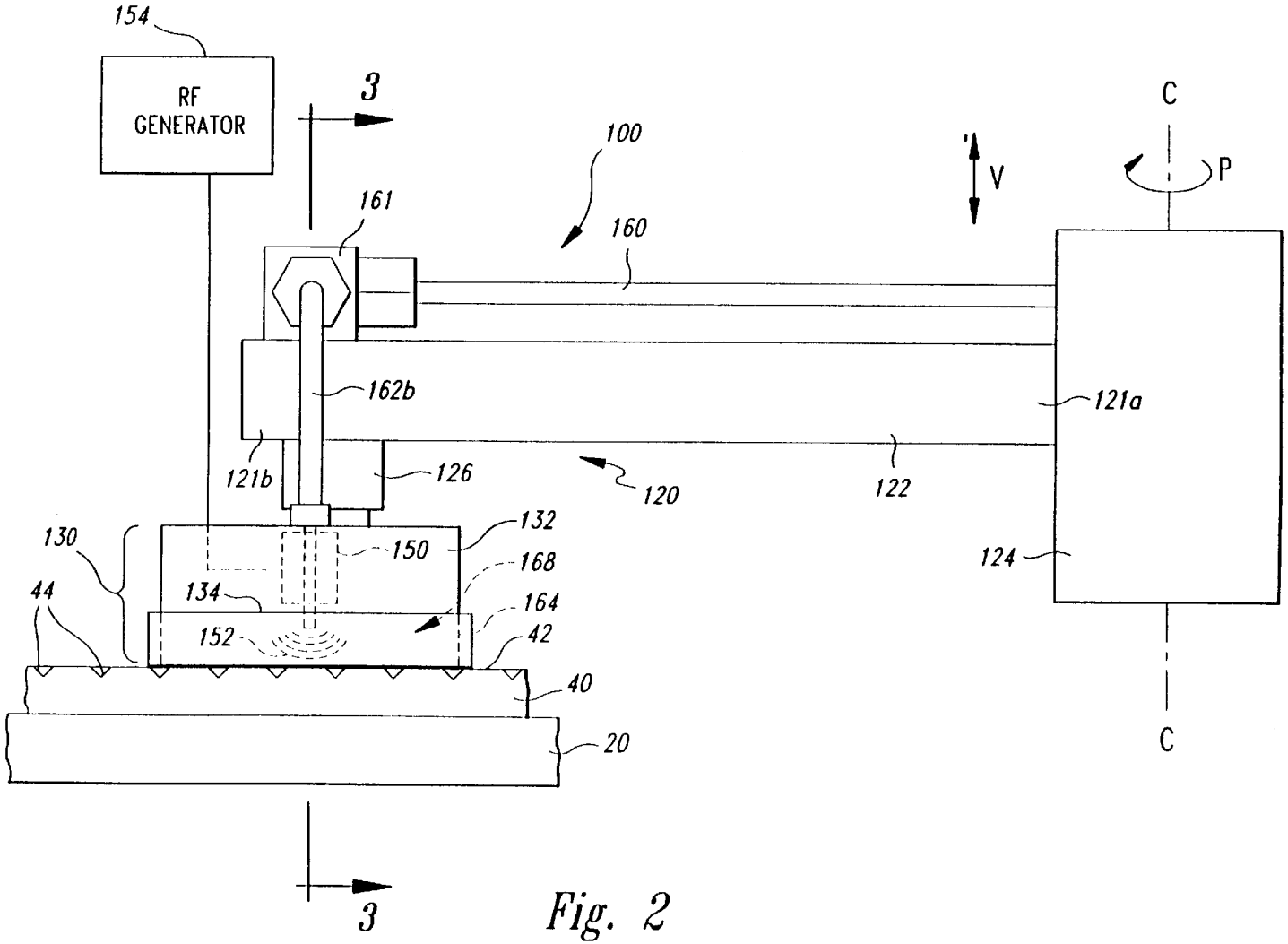
FIG. 2 is a schematic side elevational view of a conditioning machine for conditioning planarizing media in accordance with an embodiment of the invention.
Figure 3:
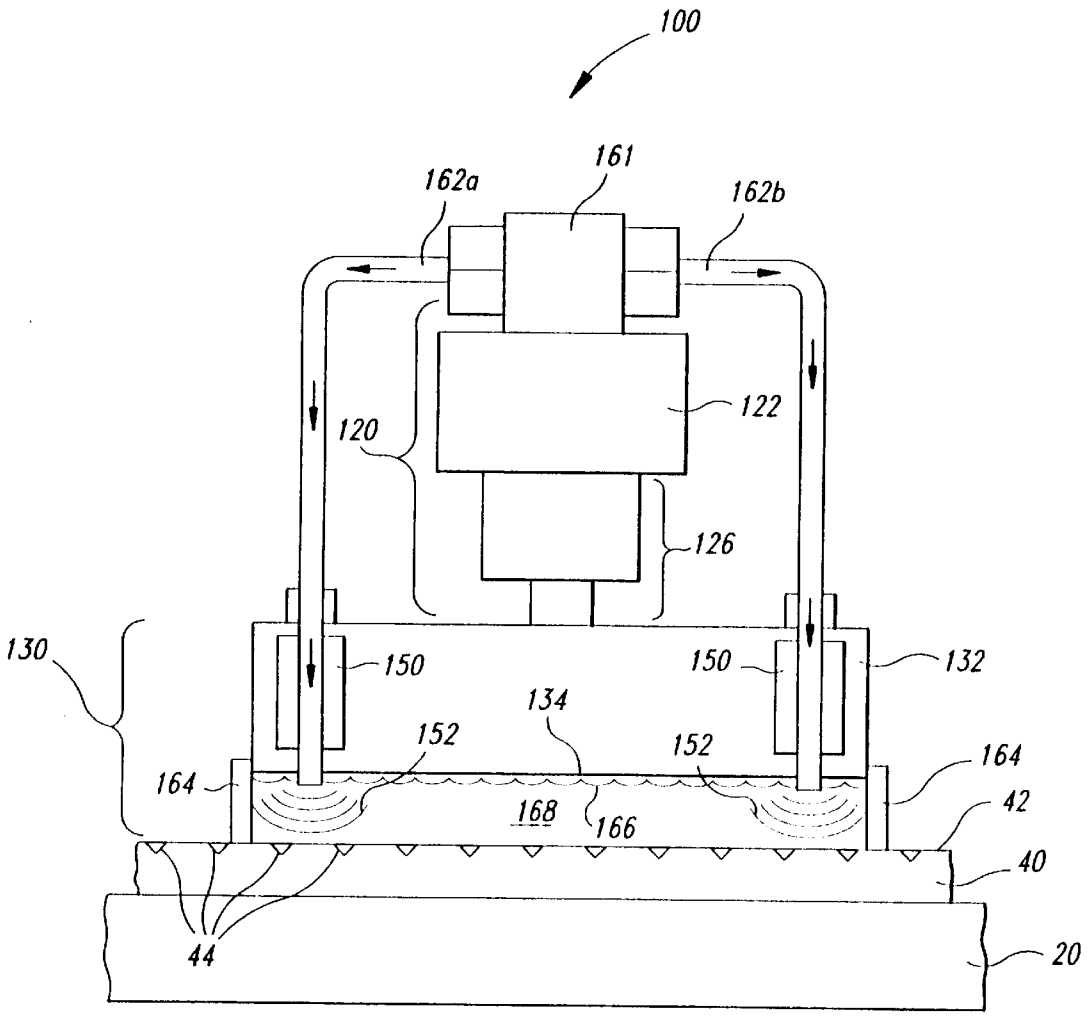
FIG. 3 is a partial schematic cross-sectional view of the conditioning machine of FIG. 2 taken along line 3—3.

FIG. 2 is a schematic side elevational view illustrating one embodiment of a conditioning machine 100 in accordance with the invention, and FIG. 3 is a partial schematic cross-sectional view of the conditioning machine 100 taken along line 3—3. The conditioning machine 100 has a support assembly 120 carrying a conditioning head 130 to condition a planarizing surface 42 of a planarizing medium 40. The support assembly 120 may have a support member or arm 122 with a first end 121*a* (FIG. 2) attached to an actuator 124 (FIG. 2) and a second end 121*b* (FIG. 2) carrying a bracket 126. The actuator 124 moves the arm 122 vertically (arrow V) and pivots the arm 122 (arrow P) to position the conditioning head 130 relative to the planarizing medium 40. The support assembly 120 may also have another actuator (not shown) coupled to the conditioning head 130 and the arm 122 instead of the bracket 126. Accordingly, different support assemblies may be used for carrying the conditioning head 130 over the planarizing medium 40.

The conditioning head 130 may have a carrier plate 132 coupled to the bracket 126 and one or more non-contact conditioning elements 150 attached to the carrier plate 132. The non-contact elements 150 may be transmitters that direct a form of non-contact energy 152 against the planarizing medium 40. For example, the non-contact energy may be an energy-beam or energy-waves 152 that act against waste matter accumulations (not shown) and the planarizing medium 40. In one particular embodiment, the non-contact elements 150 are mechanical-wave transducers that emit longitudinal mechanical waves 152 at desired frequencies and amplitudes to weaken or break apart the waste matter on the planarizing medium. The mechanical-wave transducers may accordingly be coupled to a signal generator, such as a radio frequency generator 154, to select the appropriate amplitude and frequency of the waves 152. It will be appreciated that a person skilled in the art may empirically determine the suitable waveform for operating the mechanical-wave transducers to remove a particular type of waste matter from a particular polishing medium. Moreover, a plurality of different waveforms may be used to operate each mechanical-wave transducer during a single conditioning cycle so that the mechanical energy-waves 152 remove the waste matter without damaging the planarizing medium 40 or the conditioning machine 100. Also, mechanical-wave energy at other than RF frequencies, such as at ultrasound frequencies, may be used.

When the non-contact elements 150 are mechanical-wave transducers, a fluid system may be coupled to the conditioning head 130 to maintain a volume of deionized water or another fluid as a transmission medium for the waves 152. The fluid system may have a primary conduit 160 (FIG. 2) coupled to a fluid supply (not shown), a distributor 161 coupled to the primary conduit 160, and a plurality of secondary conduits 162*a* and 162*b* (FIG. 3) coupled to the distributor 161. The secondary conduits 162*a* and 162*b* may each pass through one of the non-contact conditioning elements 150 into a cavity 168 defined by a bottom surface 134 of the carrier plate 132 and a retention skirt 164 depending downwardly from a perimeter region of the carrier plate 132. The retention skirt 164 may be a flexible material attached to the perimeter of the carrier plate 132 to maintain a transmission medium 166 in the cavity 168 as the arm 122 translates the conditioning head 130 over the planarizing medium 40. For example, the retention skirt 164 may be a rubber ring around the carrier plate 132 or a plurality of bristles (not shown). Additionally, deionized water or another fluid may also continually flow through the secondary conduits 162*a* and 162*b* to maintain the transmission medium 166 in the cavity during conditioning.

Figure 4:
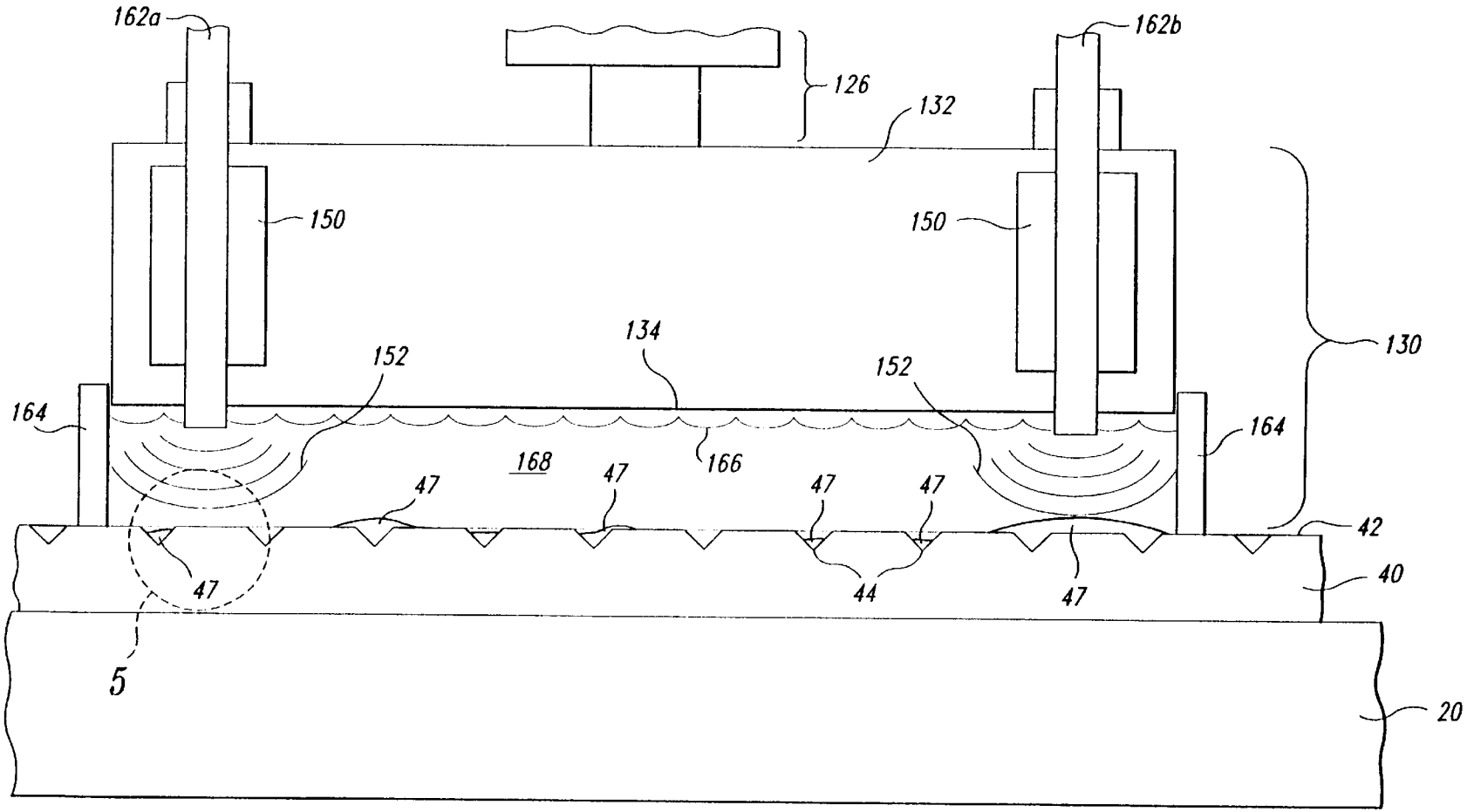
FIG. 4 is a partial schematic cross-sectional view illustrating an aspect of operating a conditioning machine in accordance with one embodiment of the invention.
Figure 5:
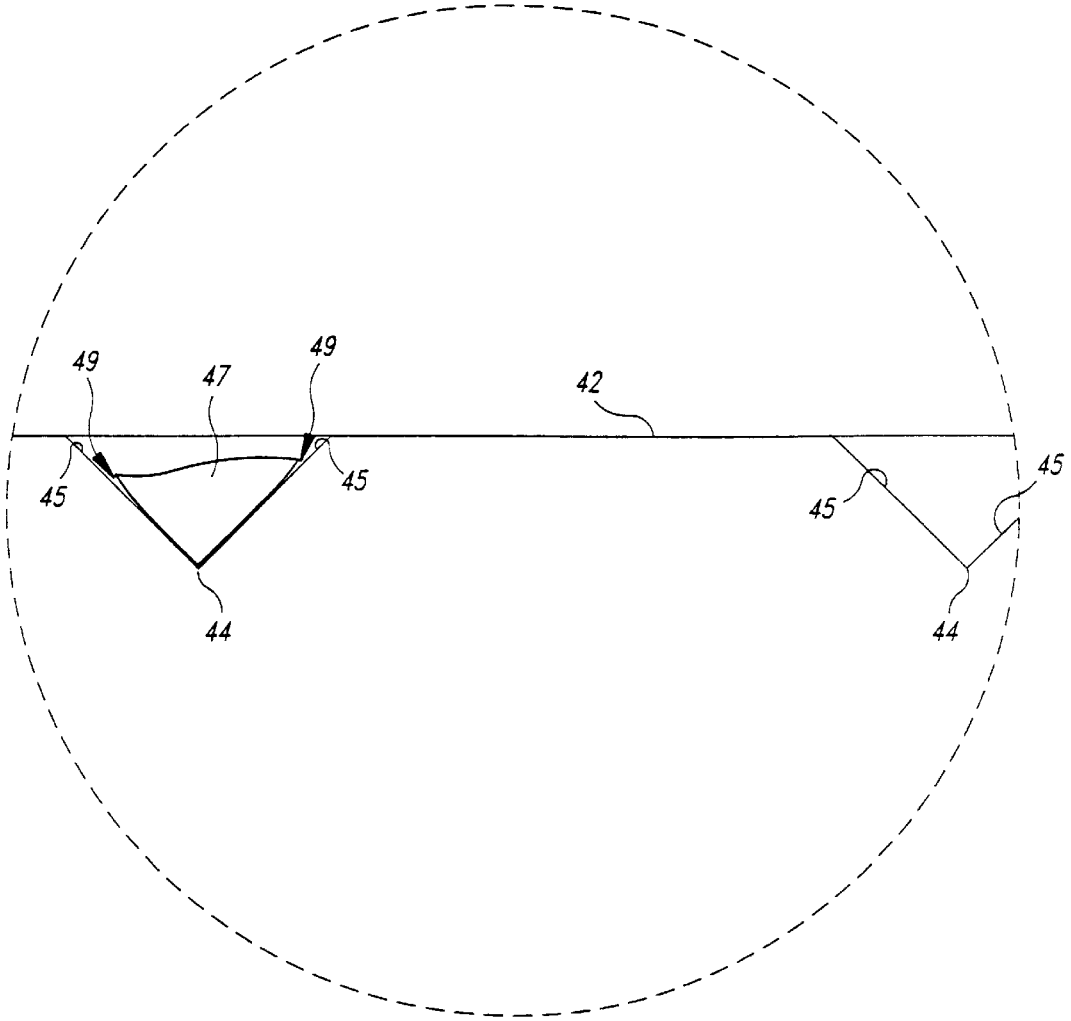
FIG. 5 is an enlarged view of a portion of the planarizing medium of FIG. 4 illustrating a detailed aspect of operating a conditioning machine in accordance with an embodiment of the invention.

FIG. 4 is a partial schematic cross-sectional view illustrating an aspect of operating the conditioning device 100 on a planarizing medium 40 with grooves 44. Additionally, FIG. 5 is an enlarged view of a portion of FIG. 4. In this example, a plurality of waste matter accumulations 47 cover portions of the planarizing surface 42 and occupy a plurality of the grooves 44. The energy-waves 152 may possibly act against the waste matter accumulations 47 and the planarizing medium 40 to break apart the waste matter accumulations 47 or to separate at least a portion of the accumulations 47 from the planarizing medium 40. In one possible application, the energy-waves 152 may alter the bonds within the waste matter and/or the bonds at the interface between the planarizing medium 40 and the waste matter accumulations 47. As best shown in FIG. 5, for example, the energy-waves 52 may possibly cause gaps 49 to form between the waste matter accumulations 47 and the inclined surfaces 45 of the grooves 44. The non-contact elements 150 may accordingly transmit the energy-waves 152 to the planarizing medium 40 until the waste matter accumulations 47 within the grooves 44 separate from the planarizing medium 40. Thus, to condition the entire surface area of the planarizing surface 42, the support assembly 120 (FIG. 4) may translate the conditioning head 130 (FIG. 4) across the planarizing medium 40 as the transducers 150 continually transmit the energy-waves 152 through the transmission medium 166.

The conditioning machine 100 may be particularly applicable for removing waste matter from fixed-abrasive planarizing media and planarizing media with depressions. The non-contact conditioning elements 150 are expected to remove waste matter embedded into a planarizing medium because the energy-waves can act against portions of the waste matter below the planarizing surface. As such, the non-contact conditioning elements 150 are expected to remove waste matter accumulations from depressions in planarizing media that would not otherwise be removed by conventional surface contact conditioning devices. Compared to conventional conditioning devices, therefore, the conditioning machine 100 is expected to return planarizing media with depressions to a state in which the media are able to hold more slurry under the substrate surface during planarization.

The planarization machine 100 is also expected to remove material from planarizing media without over conditioning some regions of the planarizing surface. As discussed above, conventional conditioning devices with abrasive elements typically produce low points on the planarizing surface because the abrasive elements may remove pad material from exposed areas of the planarizing surface while still removing waste matter from other areas. Unlike conventional conditioning devices, the conditioning machine 100 separates waste matter from a planarizing medium with a non-contact conditioning element that does not alter the contour of the planarizing surface. As such, if the planarizing surface is substantially planar prior to conditioning, the conditioning machine 100 is not expected to alter the planarity of the planarizing surface after conditioning.

Figure 6:
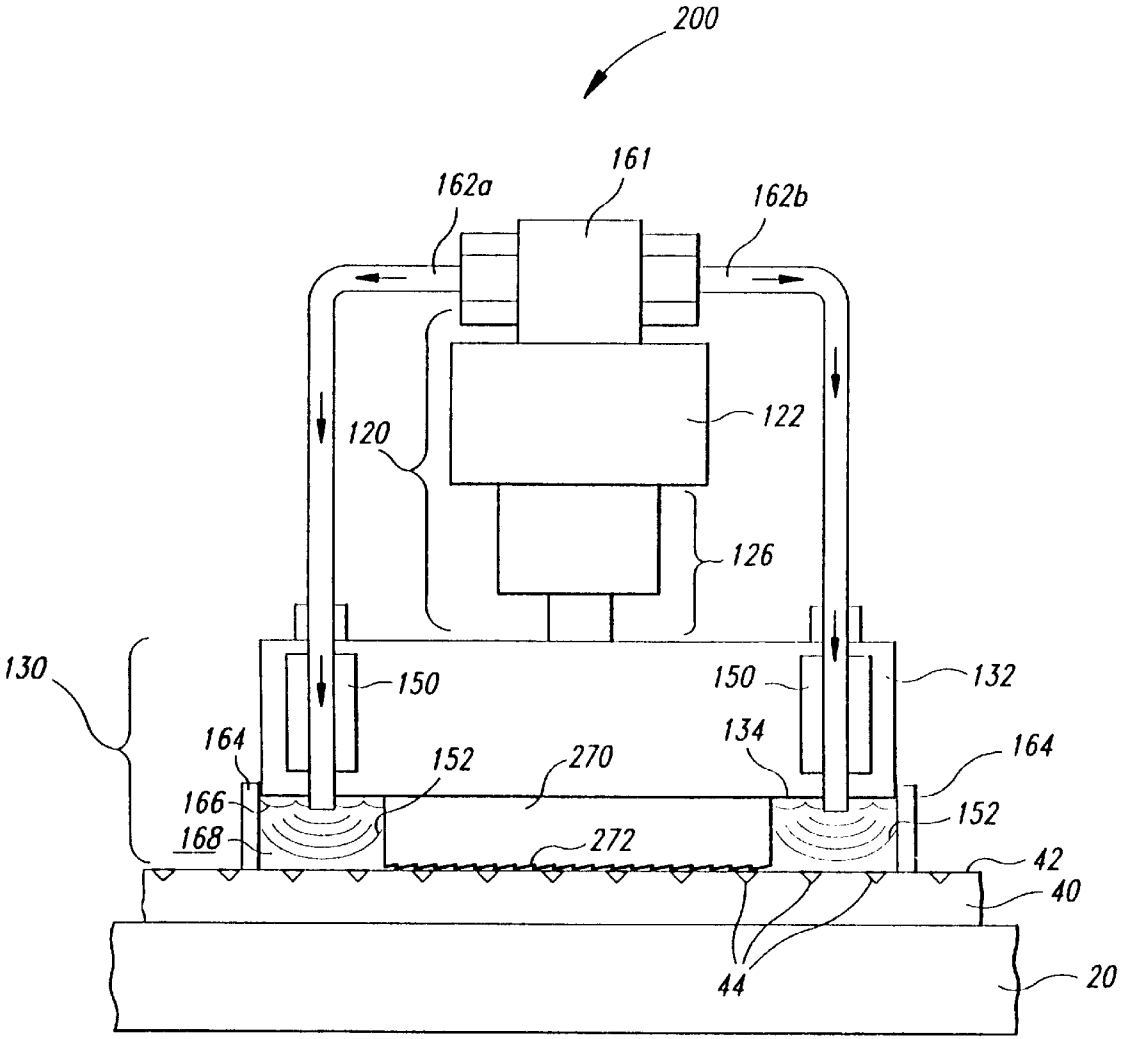
FIG. 6 is a partial schematic cross-sectional view of another conditioning machine in accordance with another embodiment of the invention.

FIG. 6 is a partial schematic cross-sectional view of another conditioning machine 200 in accordance with another embodiment of the invention. The conditioning machine 200 of FIG. 6 has many similarities with the conditioning machine 100 described above in FIGS. 2–5, and thus like reference numbers refer to similar parts in these figures. The conditioning machine 200 has a conditioning head 130 with a carrier plate 132, a plurality of non-contact conditioning elements 150 coupled to the carrier plate 132, and a retention skirt 164 depending from a perimeter region of the carrier plate 132. The conditioning head 130 also has a contact conditioning element 270 attached to the bottom surface 134 of the carrier plate 132. In one embodiment, the contact element 270 is a stone or a diamond-embedded disk with an abrasive contact face 272 for engaging the planarizing surface 42 of the planarizing medium 40. The cavity 168 for containing the transmission medium 166 is accordingly defined by the contact conditioning element 270, the carrier plate 132 and the retention skirt 164.

As described above with respect to the conditioning machine 100, the non-contact conditioning elements 150 transmit energy-waves 152 to the planarizing medium 40 to weaken or separate waste matter (not shown) from the planarizing medium 40. Additionally, the contact face 272 of the contact conditioning element 270 abrades the planarizing medium 40 to further remove waste matter from the planarizing surface 42. The conditioning machine 200, therefore, augments the non-contact removal of waste matter with a contact or abrasive force that further removes waste matter from the planarizing surface.

Figure 7:
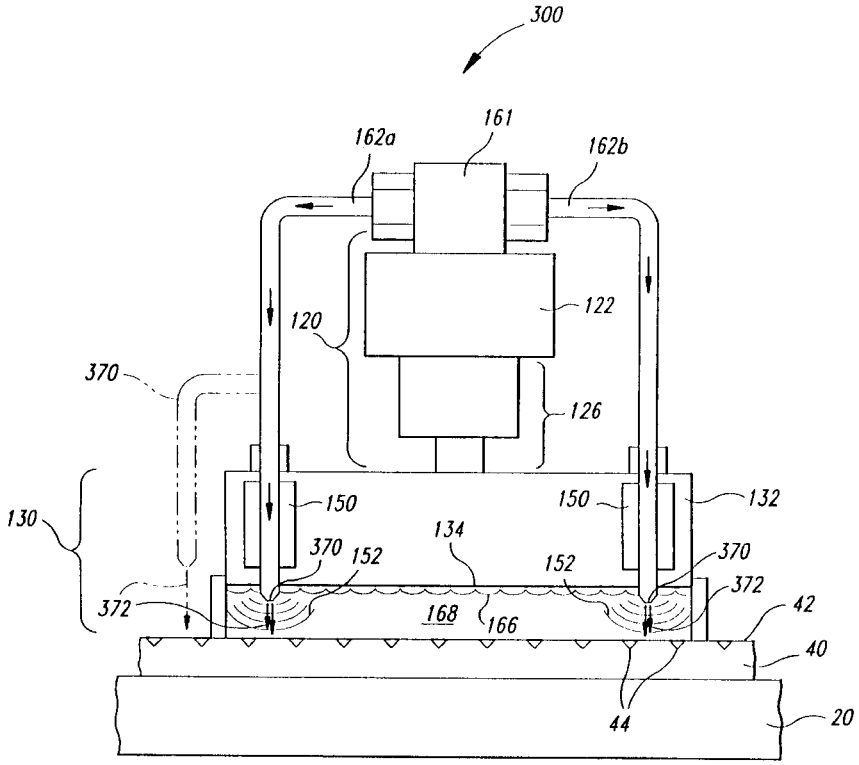
FIG. 7 is a partial schematic cross-sectional view of still another conditioning machine in accordance with still another embodiment of the invention.

FIG. 7 is a schematic cross-sectional view of still another planarizing machine 300 in accordance with still another embodiment of the invention for conditioning the planarizing medium 40. The planarizing machine 300 also has many similarities with the planarizing machines 100 and 200, and thus like reference numbers refer to similar components in FIGS. 2–7. In addition to the non-contact elements 150, the conditioning machine 300 also has one or more contact conditioning elements 370 that may be spray nozzles coupled to a fluid supply (not shown) to direct contact streams 372 of fluid against the planarizing medium 40. The spray nozzles 370 may be attached to the ends of the secondary conduits 162*a* and 162*b*, or the spray nozzles 370 may be attached to separate fluid lines outside of the retention skirt 164 (shown in phantom). In this embodiment, the contact streams 372 impinge the planarizing medium 40 as the non-contact conditioning elements 150 transmit the energy-waves 152 through the transmission medium 166. The conditioning machine 300 may be particularly useful for removing waste matter from depressions in a planarizing medium because the energy-waves 152 may form gaps between the waste matter and the surface of the planarizing medium (shown in FIG. 5), and then the contact streams 372 may flush the waste matter from the depressions.

From the foregoing, it will be appreciated that specific embodiments of the invention have been described above for purposes of illustration, but that various modifications can be made without deviating from the spirit and scope of the invention. For example, the transmission medium 166 may be a chemical composition that also selectively dissolves the waste matter accumulations. Additionally, the non-contact conditioning element may produce another form of energy that penetrates the waste matter to weaken or otherwise remove the waste matter from the planarizing medium. The retention skirt 164 may also be a plurality of stiff, densely packed bristles that define another contact element to further remove waste matter accumulations from the polishing pad. Accordingly, the invention is not limited except as by the appended claims.

What is claimed is:

1. A microelectronic substrate planarizing medium conditioner, comprising:

a support assembly having a support member positionable over a planarizing medium;

a conditioning head attached to the support member, the conditioning head having a non-contact conditioning element that transmits a non-contact energy to waste matter on the planarizing medium, wherein the conditioning head further comprises a carrier plate coupled to the support member and the non-contact conditioning element comprises a mechanical wave transmitter coupled to the carrier plate, the mechanical wave transmitter transmitting a plurality of mechanical-energy waves during conditioning; and a contact conditioning element attached to the carrier plate, the contact element being adapted to engage the planarizing medium with a contact force in conjunction with the energy-waves.

2. The conditioner of claim 1 wherein the contact conditioning element comprises a member with an abrasive contact face to abrade a planarizing surface on the planarizing medium.

3. The conditioner of claim 1 wherein the contact conditioning element comprises a nozzle coupled to a fluid supply, the nozzle directing a contact stream against the planarizing surface.

4. A microelectronic substrate planarizing medium conditioner, comprising:

a support assembly having a support member positionable over a planarizing medium;

a conditioning effector coupled to the support member, the conditioning effector having a carrier plate and a waveform generator attached to the carrier plate that imparts an energy-wave to waste matter on the planarizing medium, wherein the waveform generator comprises a mechanical-wave transmitter coupled to an RF generator, the mechanical wave-transmitter transmitting mechanical energy-waves to the planarizing medium during conditioning; and a contact conditioning element attached to the carrier plate, the contact element being adapted to engage the planarizing medium with a contact force in conjunction with the energy-waves.

5. The conditioner of claim 4 wherein the contact conditioning element comprises a member with an abrasive contact face to abrade a planarizing surface on the planarizing medium.

6. The conditioner of claim 4 wherein the contact conditioning element comprises a nozzle coupled to a fluid supply, the nozzle directing a contact stream against the planarizing surface.

7. A microelectronic substrate planarizing machine, comprising:

a table with a support base;

a planarizing medium mounted on the support base;

a carrier assembly having a substrate holder positionable over the planarizing medium, the substrate holder having a chuck to hold a microelectronic substrate, wherein at least one of the planarizing medium and the substrate holder moves to translate the substrate across the planarizing medium during planarization;

a conditioner support assembly having a support member positionable over the planarizing medium;

a conditioning head attached to the support member, the conditioning head having a non-contact conditioning element that transmits a form of non-contact energy to waste matter on the planarizing medium, wherein the conditioning head further comprises a carrier plate coupled to the support member and the non-contact conditioning element comprises a mechanical-wave transmitter coupled to the carrier plate, the mechanical-wave transmitter transmitting a plurality of mechanical energy-waves during conditioning; and a contact conditioning element attached to the carrier plate, the contact element being adapted to engage the planarizing medium with a contact force in conjunction with the energy-waves.

8. The machine of claim 7 wherein the contact conditioning element comprises a member with an abrasive contact face to abrade a planarizing surface on the planarizing medium.

9. The machine of claim 7 wherein the contact conditioning element comprises a nozzle coupled to a fluid supply, the nozzle directing a contact stream against the planarizing surface.

* * * * *